US005967386A

United States Patent [19]

Chou

[11] Patent Number: 5,967,386

[45] Date of Patent: Oct. 19, 1999

[54] TROUSER PRESSING APPARATUS

[76] Inventor: Kam Wa Chou, 405 Columbus Ave. #103, Boston, Mass. 02116

[21] Appl. No.: 09/120,541

[22] Filed: Jul. 22, 1998

[51] Int. Cl.[6] ..... D06F 71/29

[52] U.S. Cl. ..... 223/73; 38/16

[58] Field of Search ..... 38/12, 14, 16, 38/1 A, 7 D, 66; 223/57, 70, 72, 73, 76, 63, 67

[56] References Cited

U.S. PATENT DOCUMENTS

| | | | |
|---|---|---|---|
| 2,092,278 | 9/1937 | Harvey | 223/73 |
| 2,412,900 | 12/1946 | Mayer | 223/72 |
| 2,772,039 | 11/1956 | Hoover et al. | 223/73 |
| 2,956,714 | 10/1960 | Rosenthal et al. | 223/74 |
| 3,263,877 | 8/1966 | Radford | 223/73 |
| 3,433,396 | 3/1969 | Swartz . | |
| 3,550,820 | 12/1970 | O'Boyle . | |
| 3,556,361 | 1/1971 | O'Boyle . | |
| 4,485,572 | 12/1984 | Frushtick . | |
| 5,361,516 | 11/1994 | Dahman . | |

OTHER PUBLICATIONS

Seickel & Sons Inc. Flyer for "Creaseless Pants Steamer"—1 page, undated.

*Primary Examiner*—Ismael Izaguirre
*Attorney, Agent, or Firm*—Baker & Botts

[57] ABSTRACT

An apparatus for pressing a pair of trousers includes a steam supply manifold with an inlet and an outlet end and right and left leg steam ducts which are in communication with the outlet end of the main steam supply manifold. The right and left leg steam ducts are adapted to introduce steam into the right and left legs, respectively, of a pair of trousers. An expandable waist clamp assembly is secured to the right and left leg ducts and is expandable between a first position which allows the trousers to be easily introduced over the assembly, and a second expanded position which securely retains and helps to shape the trousers during the pressing operation. Elongate right and left leg support members are provided with a length sufficient to accept the legs of the trousers and can be pivotally mounted to the right and left leg ducts so as to pivot between a first horizontal position which allows the trousers to be easily mounted onto the apparatus and a second vertical position which is adapted for pressing of the trousers. Right and left leg trouser shaping assemblies can be provided and can be secured to the right and left leg support members. The shaping assemblies are adapted for insertion into the legs of the trousers and are expandable between a first position which allows easy insertion and a second position where the shaping assemblies engage and shape the trousers.

17 Claims, 13 Drawing Sheets

TROUSER PRESSING APPARATUS

BACKGROUND OF THE INVENTION

1. Field of the Invention

The present invention relates to devices for pressing and finishing clothing, and more particularly relates to a trouser pressing apparatus.

2. Brief Description of the Prior Art

Various machines are known to assist in forming or otherwise treating articles of clothing. For example, U.S. Pat. No. 3,550,820 to O'Boyle discloses a garment treating apparatus. The apparatus is adapted to treat the upper portion of a pair of trousers and includes an extremely complex expandable form for the trousers. Steam is employed. No provision is made to treat the legs of the trousers; only the upper portion of the trousers can be treated.

U.S. Pat. No. 3,433,396 to Swartz discloses a garment pressing apparatus and method. Again using steam, shaping and wrinkle removing can be accomplished for a garment having tubular portions. U.S. Pat. No. 3,556,361 to O'Boyle discloses a garment treating apparatus similar to the previously-discussed O'Boyle Pat. U.S. Pat. No. 4,485,572 discloses a waist expander for a trouser finisher. U.S. Pat. No. 5,361,516 to Dahman discloses a device and method for drying pants wrinkle-free. The basic concept is to provide expandible pieces for the waist of the pants and to blow hot air into the interior of the pants with a hair dryer.

While the above-described prior art apparatuses have been helpful in treating trousers and similar garments, they exhibit certain deficiencies. For example, the portions adapted to hold the waist of the trousers can be quite complex. Further, it may be inconvenient to position the trousers on these apparatuses for treatment. Yet further, the devices may not be capable of treating the entire pair of trousers at the same time, nor may they be capable of creasing the trouser leg at the same time that the rest of the pants are being treated. Yet further, they may not make any provision for treatment of ladies'pants or trousers, wherein it may be desirable to form a pleasing round cuff shape without creasing of the trouser legs. Accordingly, there is a need for a trouser pressing apparatus with a simplified waist clamp assembly, which permits easy introduction of the trousers onto the apparatus as well as convenient positioning for treatment of same, and which is capable of shaping the legs of the trousers while treatment is being carried out. It would be desirable if the shaping could include either creasing of men's trousers or cuff-forming for ladies'trousers.

SUMMARY OF THE INVENTION

The present invention, which addresses the needs of the prior art, provides an apparatus for pressing a pair of trousers. It is an object of the present invention to provide such an apparatus to which the trousers may be conveniently attached for treatment, and in which the trousers can be positioned in a desirable location for such treatment.

Furthermore, it is an object of the present invention to provide such an apparatus which is capable of shaping the legs of trousers which are being treated, by either creasing or cuff-forming.

Still further, it is an object of the present invention to provide such an apparatus with a simplified waist clamp assembly.

Yet further, it is another object of the present invention to provide such an apparatus which can work with existing steam apparatus, such as those which can be found in tailor shops, dress-maker's shops, dry cleaners, garment manufacturing establishments, and the like.

The apparatus of the present invention includes a main steam supply manifold having an inlet end and an outlet end. Right and left leg steam ducts each have an inlet end in communication with the outlet end of the main steam supply manifold, and each have an outlet end adapted to introduce steam into the right and left legs of the pair of trousers, respectively. The apparatus further includes an expandable waist clamp assembly which is secured to the right and left leg ducts. The waist clamp assembly is expandable between a first position which is selected for easy introduction of the waist portion of the trousers over the waist clamp assembly, and a second, expanded position which is selected for secure retention and shaping of the waist portion of the trousers.

The apparatus further includes elongate right and left leg support members each having first and second ends and a length which is sufficient to accept the legs of the trousers. The first ends of the leg form assemblies can be pivotally mounted to the right and left leg ducts so as to pivot between a first horizontal position adapted for easy introduction of the trousers onto the apparatus and a second vertical position adapted for pressing of the trousers. Further, right and left trouser leg shaping assemblies can be included and can be secured to the right and left leg form assemblies respectively. The trouser leg shaping assemblies are adapted for insertion into the respective legs of the trousers and are expandable between a first position which is adapted for easy insertion of the leg shaping assemblies into the trouser legs and a second position where the shaping assemblies engage and shape the trousers. The right and left trouser leg shaping assemblies are located and dimensioned to press and shape at least lower portions of the right and left legs of the trousers.

These and other objects, features and advantages of the present invention will be described in the following specification, taken in connection with the accompanying drawings, and the scope of the invention will be pointed out in the appended claims.

BRIEF DESCRIPTION OF THE DRAWINGS

FIG. 4D is a top plan view of a sleeve member of the assembly of FIG. 4B;

DETAILED DESCRIPTION OF THE INVENTION

Figure 1:
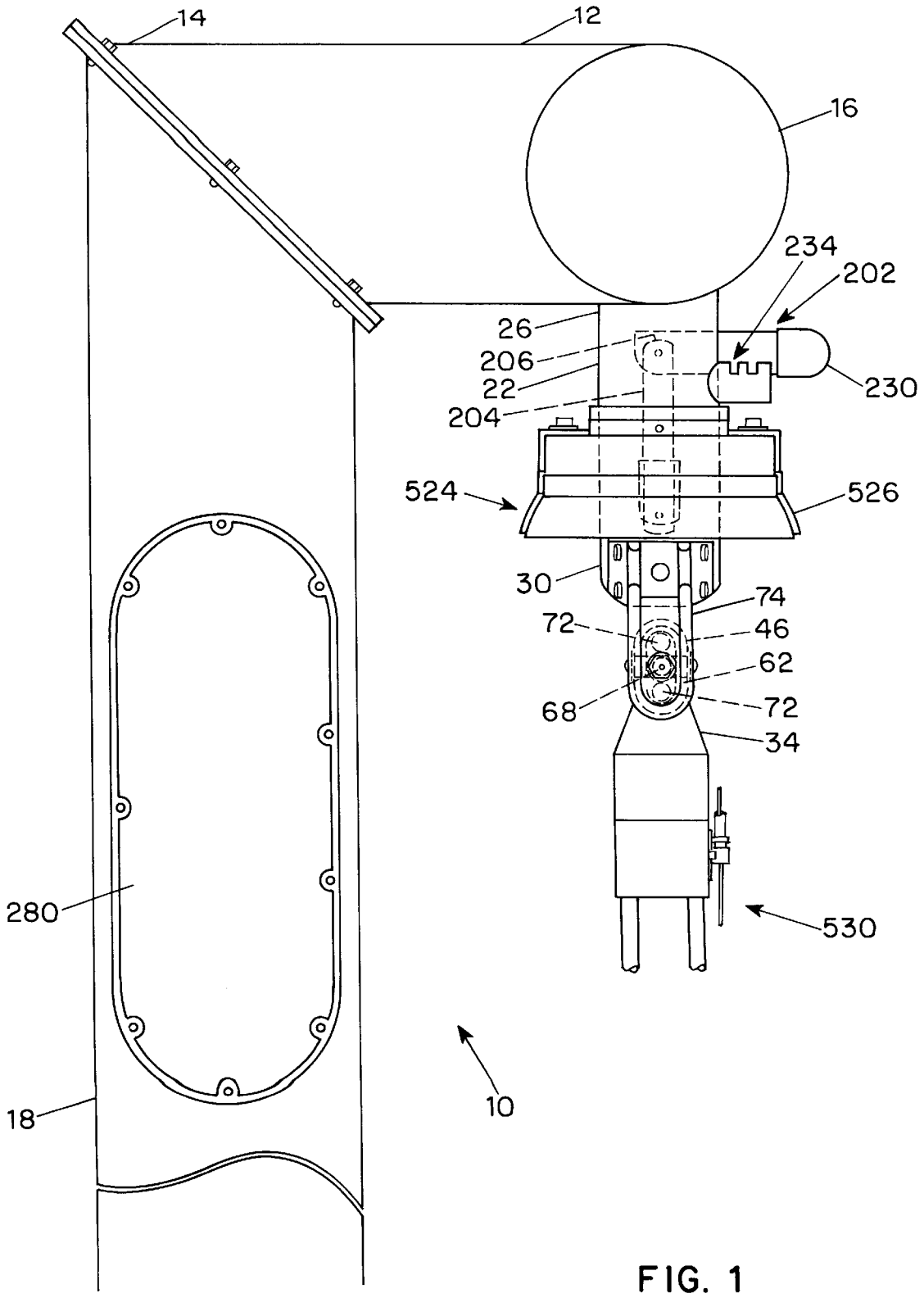
FIG. 1 is a right side elevational view of an apparatus according to the present invention with a base portion thereof omitted.
Figure 2:
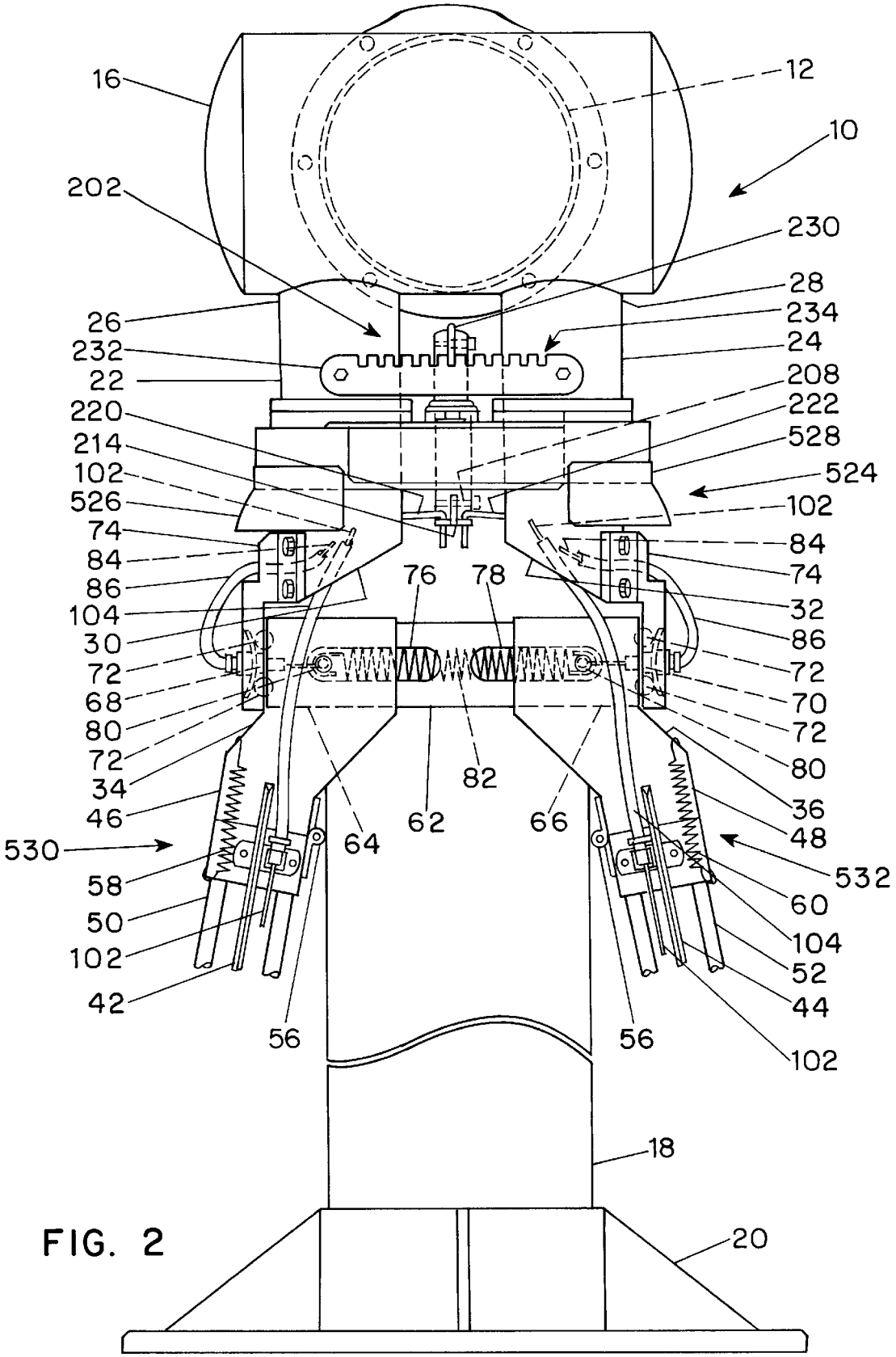
FIG. 2 is a front elevational view of an apparatus according to the present invention.

Reference should now be had to FIGS. 1 and 2 which depict an apparatus for pressing a pair of trousers having right and left legs and a waist portion, in accordance with the present invention. Apparatus 10 includes a main steam supply manifold 12 having an inlet end 14 and an outlet end 16. An upright duct 18 can be used to supply steam to the main steam supply manifold 12, and can be provided with a suitable mounting portion 20. Any desired source of steam can be used. For example, suitable connections can be provided on main steam supply manifold 12 or upright duct 18 to interface with an existing steaming machine such as the Cissell FMFC SUZY base, or any other steaming machine as is known in the garment and apparel arts. Apparatus 10 also includes right and left leg steam ducts 22, 24 each having an inlet end 26, 28 respectively and an outlet end 30, 32 respectively. Inlet ends 26, 28 are in communication with outlet end 16 of main steam supply manifold 12. Outlet ends 30, 32 of ducts 22, 24 are adapted to introduce steam into the right and left leg of a pair of trousers respectively. With reference to FIG. 2, it will appreciated that the trousers can be mounted on the apparatus with the front of the trousers facing outward. Accordingly, the right duct 22 is depicted on the left side of the figure, and the left duct 24 is depicted on the right side of the figure.

Apparatus 10 also includes an expandable waist clamp assembly, designated generally as 524, which is secured to the right and left leg ducts 22, 24. As shown in the figures, assembly 524 is secured directly to the ducts, but it is to be understood that it could also be secured by appropriate intermediate structure. Waist clamp assembly 524 is expandable between a first position selected for easy introduction of the waist portion of the trousers over the waist clamp assembly and a second, expanded position which is selected for secure retention and shaping of the waist portion of the trousers. Waist clamp assembly 524 can include at least a first pair of opposed, generally horseshoe-shaped waist form members 526, 528 which can be linearly moveable between the first and second positions. Further details will be provided below.

Apparatus 10 further includes elongate right and left leg support members 530, 532 each having first ends 34, 36 respectively and each having second ends 38, 40 respectively. The second ends 38, 40 are not shown in FIGS. 1 and 2 for illustrative convenience, but will be discussed further below. Each of the support members 530, 532 has a length sufficient to accept the legs of the trousers. The first ends 34, 36 of the leg form assemblies are mounted to the right and left leg ducts 22, 24 respectively, preferably in a manner so as to pivot between a first horizontal position adapted for easy introduction of the trousers onto the apparatus and a second vertical position adapted for pressing of the trousers. Non-pivotal mounting is also possible. The members 530, 532 are shown in the vertical position in FIGS. 1 and 2. Further details regarding the pivoting will be presented below.

Apparatus 10 optionally further includes right and left trouser leg shaping assemblies 42, 44 secured respectively to the right and left leg support members 530, 532. The trouser leg shaping assemblies 42, 44 are adapted for insertion into the respective legs of the trousers and are expandable between a first position adapted for easy insertion of the leg shaping assemblies into the trouser legs and a second position where the shaping assemblies engage and shape the trousers. The right and left trouser leg shaping assemblies 42, 44 can be located and dimensioned to press and shape at least lower portions of the right and left legs of the trousers. Alternatively, upper or intermediate portions, all portions, or any combination thereof can be treated as desired. With reference to FIG. 2, only a small portion of the shaping assemblies 42, 44 is shown for illustrative convenience. The embodiment shown in FIG. 2 includes shaping assemblies adapted to crease trousers. Other types of shaping assemblies can also be employed, and will be discussed more fully below, as will the creasing assemblies.

With reference to FIG. 2, the right and left leg support members 530, 532 are preferably translatable towards and away from each other in order to accommodate different sized trousers. The right and left leg support members 530, 532 can include upper portions 46, 48 respectively which are pivotally mounted to the right and left ducts 22, 24. Further, the leg support members 530, 532 can also include respective lower portions 50, 52 which are hinged with respect to the upper portions through, for example, suitable hinges 54, 56 respectively. The hinging is provided so that the lower portions 50, 52 can swing towards each other for easy introduction of the trousers onto the apparatus. Preferably, the lower portions 50, 52 are elastically biased with respect to the upper portions 46, 48. They are preferably elastically biased away from each other for proper forming of the trousers. They are shown in FIG. 2 in the position where they are biased away from each other. The elastic bias can be provided, for example, by suitable extension springs 58, 60 respectively.

Further details will now be provided regarding the right and left leg support members 530, 532, including exemplary mounting details and an exemplary fashion in which they can be made to be translatable towards and away from each other to accommodate different size trousers, as discussed above. Apparatus 10 can be provided with a suitable cross-member 62 having first and second ends 64, 66 respectively. Further, apparatus 10 can be provided with first and second rotary bearings 68, 70 having ball detents 72. The first and second rotary bearings 68, 70 can be respectively mounted between the first and second ends 64, 66 of the cross member 62 and the right and left steam ducts 22, 24. Such mounting can be provided, for example, by means of suitable mounting brackets 74. Upper portions 46, 48 of support members 530, 532 can be slidably secured to cross member 62 and can have rotational fixity thereabout. Ball detents 72 can be positioned to releasably secure the cross member 62 in a position which corresponds to at least one of the aforementioned first horizontal and second vertical positions of the support members 530, 532. Again, FIGS. 1 and 2 show the support members in the vertical position. With reference to FIG. 1, it will be appreciated that the support members 530, 532 (only support member 530 is seen in FIG. 1) could pivot upwardly which would be approximately 90° in a counter-clockwise fashion in FIG. 1. Upper portions 46,48 of shaping assemblies 42, 44 can be pivotally mounted to the right and left leg steam ducts 22, 24 by virtue of being secured to the cross member 62 which, as discussed, can pivot with respect to the ducts 22, 24 about the first and second rotary bearings 68, 70.

Cross member 62 can be formed with at least one longitudinal slot, and in a preferred form, with two such slots 76, 78. Apparatus 10 can further include at least one transverse pin associated with each of the upper portions 46, 48 of the shaping assemblies 42, 44. The transverse pins are identified in FIG. 2 as items 80. The pins 80 ride in the at least one longitudinal slot, and preferably in the two longitudinal slots 76, 78 as shown. Apparatus 10 can yet further include an elastic member, such as an extension spring 82 which is positioned to bias the upper portions 46, 48 towards each other. Apparatus 10 can further include a pair of lockable pulleys, to be discussed more fully below, and a pair of cables 84 each of which has a first end secured to a respective one of the upper portions 46, 48 and a second end secured to a respective one of the lockable pulleys. The cables can ride in suitable sheaths 86.

Reference should now be had back to FIG. 1 which shows one manner in which the aforementioned rotational fixity between the upper portions of the support members and the cross member can be achieved. As shown, upper portion 46 of right leg support member 530 can be formed with a generally oblong profile, and cross member 62 can be formed with a similar oblong profile configured to fit inside that of upper portion 46. Because of the side flats on the oblong profiles, no rotation is possible between the two elements. It is to be understood that this manner of achieving rotational fixity is exemplary, and any other suitable method can be employed, for example, by means of a key member, a single flat, and the like.

Figure 8:
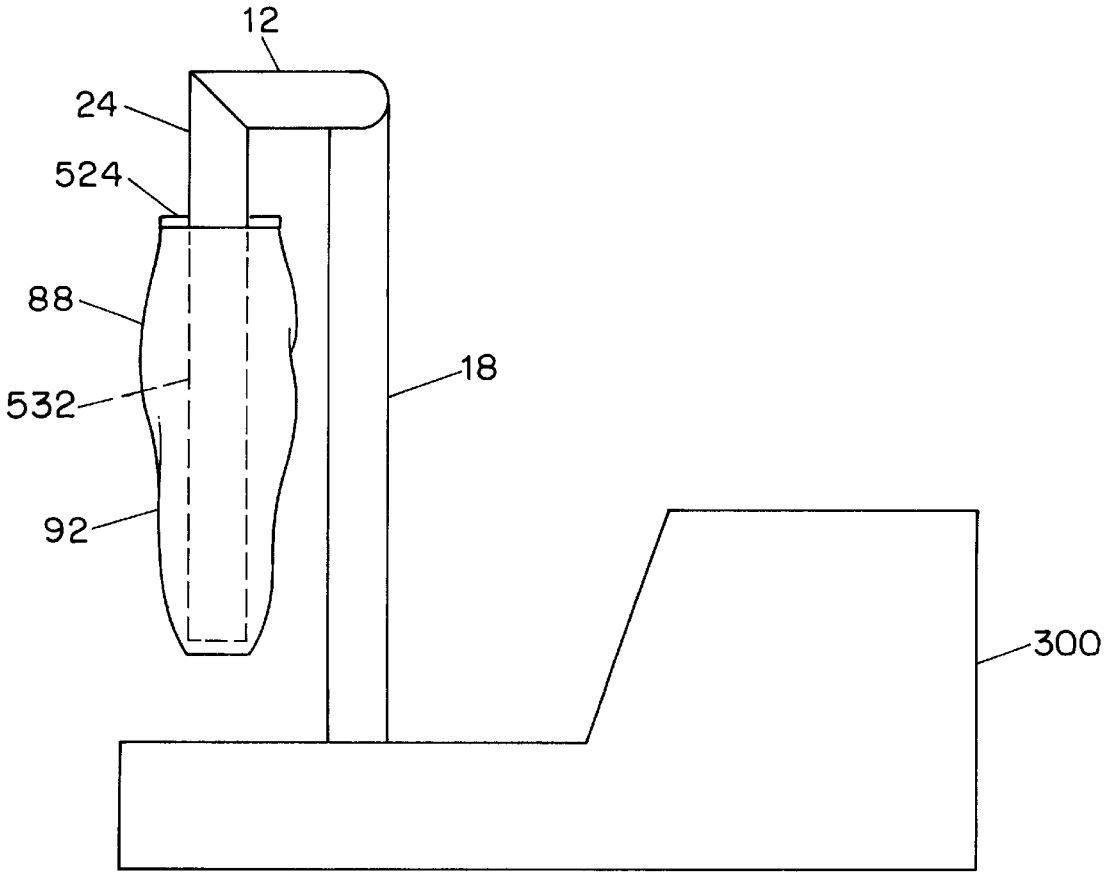
FIG. 8 is a view of the present invention adapted to the prior art dress form steam supply.
Figure 9:
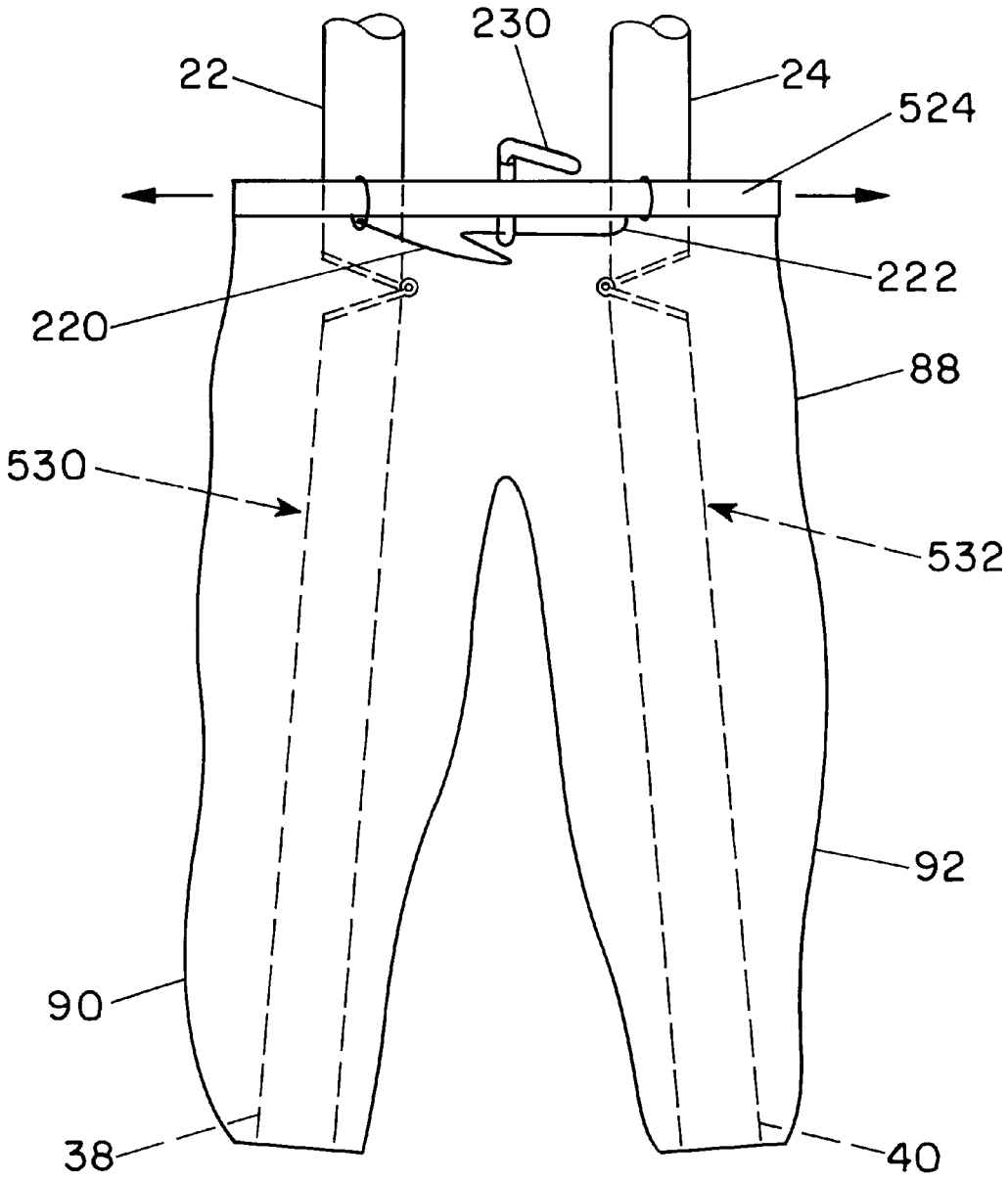
FIG. 9 is a partial, semi-schematic view of the present invention showing a form bag thereof which is generally in the shape of pair of trousers.

Apparatus 10 can also include a steam-permeable form bag 88 which is mounted to the waist clamp assembly 524 (See FIGS. 8 and 9). Form bag 88 can have right and left leg portions 90, 92 respectively which are positioned to contain the leg support members 530, 532 and the trouser leg shaping assemblies 42, 44. The form bag 88, including the right and left leg portions 90, 92 is adapted to be inserted into the trousers, including, respectively, the right and left legs of the trousers.

Figure 3A:
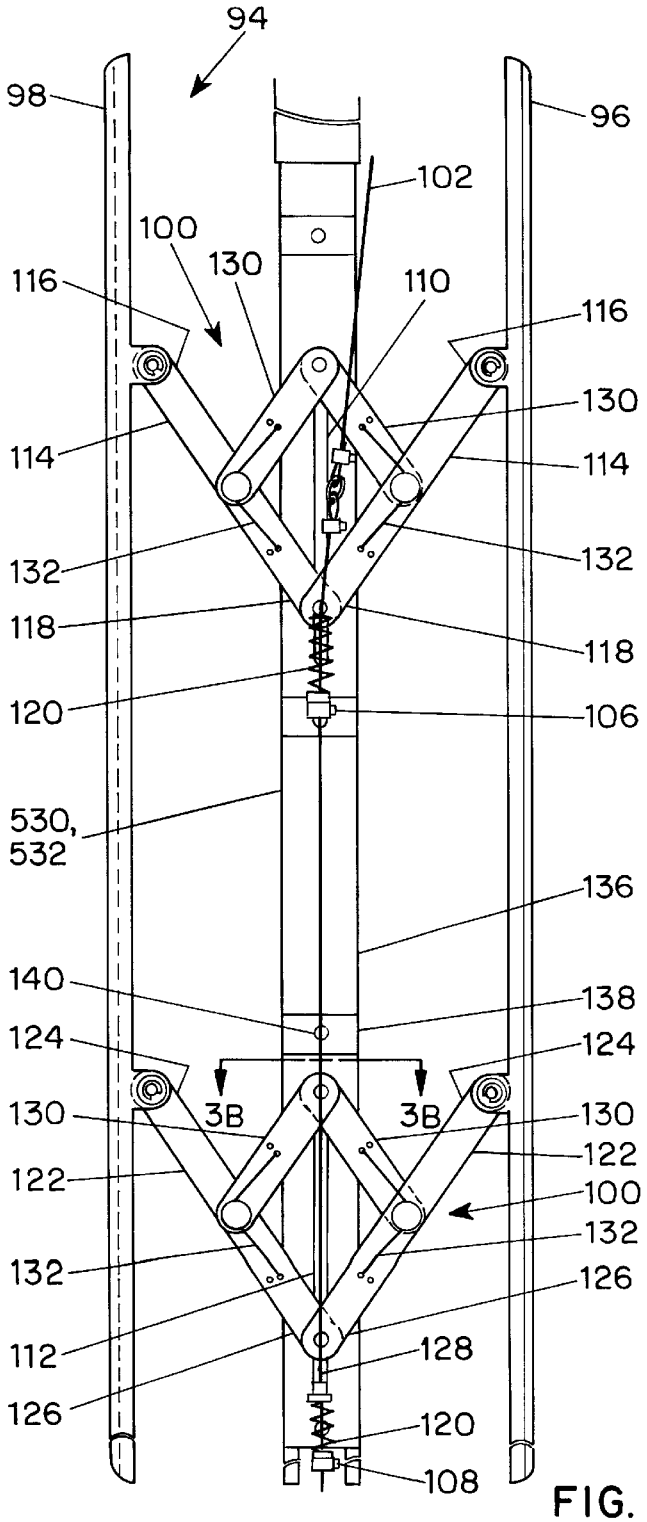
FIG. 3A is an assembled view of a trouser creasing assembly of the present invention.

Reference should now be had to FIG. 3A. In one embodiment of the apparatus 10, the right and left leg shaping assemblies 42, 44 can be creasing assemblies. An exemplary creasing assembly is depicted in FIG. 3A and is designated generally as 94. The exemplary creasing assembly 94 can include a front blade member 96 and a rear blade member 98. The front and rear blade members can be adapted to crease corresponding front and rear portions of the right and left trouser legs. The blades 96, 98 can be sized to crease substantially the whole length of the trouser legs. Exemplary dimensions will be set forth below. Creasing assembly 94 can also include an elastically biased linkage, designated generally as 100 which is interposed between the front and rear blade members 96, 98 and between the corresponding one of the right and left leg support members 530, 532 respectively. Linkage 100 is configured to elastically bias the front and rear blade members 96, 98 towards each other to permit easy insertion of the blade members into the respective trouser legs. Elastically biased linkage 100 also includes an actuator, which can be a locking actuator, which urges the blade members apart to crease the respective trouser legs. The actuator will also be discussed further below.

The aforementioned actuator can include a cable 102 running in a suitable sheath 104, as best seen FIG. 1. The cable can be secured at one end to a (preferably lockable) pulley, to be discussed below, and the actuator can also include upper and lower stop members 106, 108 respectively which are secured to the cable 102. The right and left leg support members 530, 532 can each be formed with upper and lower longitudinal slots 110, 112 respectively therein. The elastically biased linkage 100 can include an upper pair of expanding links 114 each having first ends 116 pivotally secured to the front and rear blade members 96, 98 respectively and each having second ends 118 secured together, preferably in a pivotal fashion, and slidable in the upper longitudinal slot 110. The upper pair of expanding links 114 can be configured to receive an upwardly-applied expanding force from the upper stop member 106 when the cable 102 is tensioned. If desired, this force can be applied through a compression spring 120, the two of which can be sized to have a pre-compression to prevent slack or slop in operation of cable 102. Elastically biased linkage 100 can also include a lower pair of expanding links 122 each of which has a first end 124 pivotally secured to the front and rear blade members 96, 98 respectively and each of which has a second end 120, the two of which are pivotally secured together and which are slidable in the lower longitudinal slot 112. The lower pair of expanding links 122 can be configured to receive an upwardly applied expanding force from the lower stop member 108 when the cable 102 is tensioned. The lower stop member 108 can be spaced from the lower pair of expanding links 122 so as to delay expansion of the lower pair of expanding links with respect to the upper pair of expanding links. Such delay permits the upper portions of the right and left trouser legs to be expanded further than the lower portions of the right and left trouser legs; thus, tapering of the right and left trouser legs can be accommodated.

Still referring to FIG. 3A, the lower pair of expanding links 122 can receive the upwardly-applied force from lower stop member 108 through an additional compression spring 120. Lower stop member 108 can be located such that there is a gap 128 between the far end of the lower compression spring 120 and the lower expanding links 122. This allows the delay between the expansion of the upper and lower portions of the blades 96, 98 as discussed above. Suitable short link members 130 can be provided and can be pivoted to the right and left leg support members 530, 532 at first ends and to intermediate portions of the upper and lower expandible links 114, 122 at opposite ends. Suitable torsion springs 132 can be provided to bias the blades 96, 98 apart, as discussed above. It will be appreciated that front and rear blade members 96, 98 can have a suitable knife-edge configuration, as desired, to impart a sharp crease.

Figure 3D:
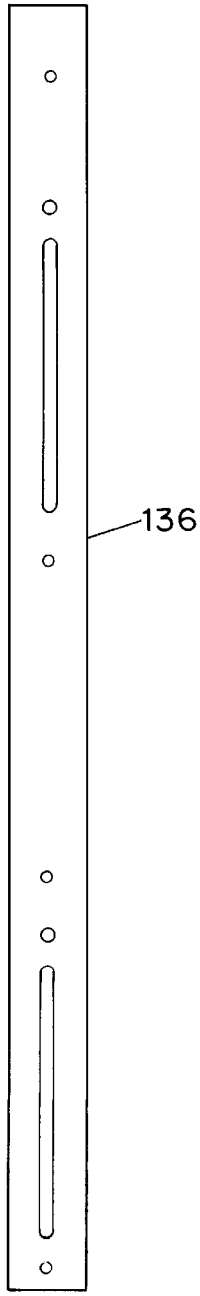
FIG. 3D is a full-face view of the member of FIG. 3C.
Figure 3B:
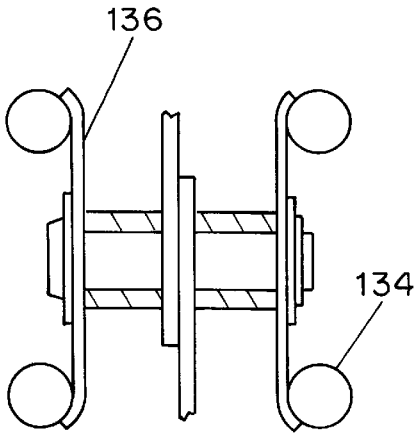
FIG. 3B is a partial top, cross-sectional view of the apparatus of FIG. 3A taken along line B—B of FIG. 3A.
Figure 3C:
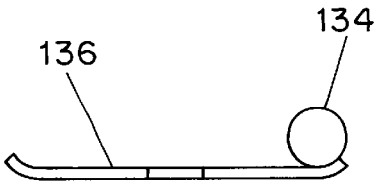
FIG. 3C is an end view of a spine member in accordance with the present invention.

With continued reference to FIG. 3A, attention should also now be given to FIG. 3B, which is a cross sectional view taken along line B—B of FIG. 3A. As shown therein, right and left leg support members 530, 532 can include, for example, four tubular rods 134 fastened together in pairs by suitable support plates 136. Support plates 136 can be formed in a spine-like manner and extend substantially over the whole length of the members 530, 532. The pairs of rods 134 held to a support plate 136 (by, for example, welding) can in turn be fastened by suitable cross-members 138 secured with suitable bolts and nuts or other fasteners 140. It will be appreciated that sectional view 3B is rotated 90° in orientation from FIG. 3A such that the support plates 136 appear vertical rather than horizontal. FIGS. 3C and 3D are side and top views respectively of a support plate 136. The plate can have an overall length of, for example, 34.5 inches. It should be appreciated that, while this length has been found suitable for pressing a wide variety of trousers, any operable length is within the scope of the present invention. It will also be appreciated that a single tubular rod 134 is shown in FIG. 3C for reference purposes.

Figure 3E:
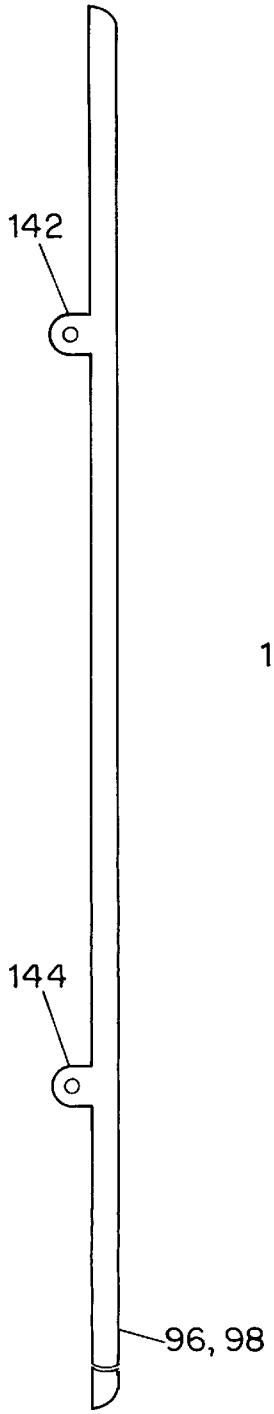
FIG. 3E is a view of a blade of the assembly of FIG. 3A.
Figure 3F:
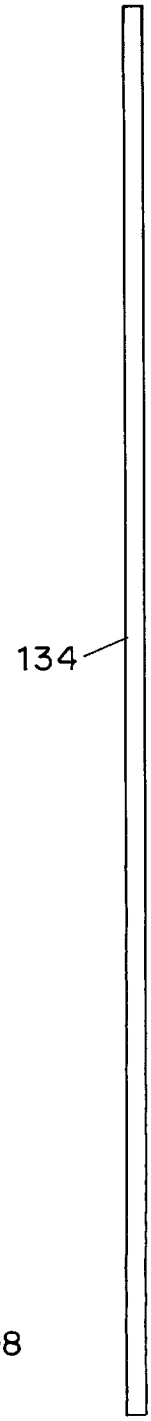
FIG. 3F is a view of a rod member of the assembly of FIG. 3A.

FIG. 3E shows an exemplary front or rear blade 96,98. The overall length can be, for example, about 41 inches. Again, while this dimension has been found useful for pressing a wide variety of trousers, any operable length is considered to be within the scope of the present invention. Blade members 96, 98 can have suitable upper pivots points 142 and lower pivot points 144. Upper pivot point 142 can be spaced about 8.5 inches down from the top of blade 96, 98, while the upper and lower pivot points can be spaced about 28 inches apart from each other. Again, these dimensions have been found desirable for pressing a wide range of trousers, but should not be taken as limiting. FIG. 3F shows a detail of an exemplary tubular rod 134. Rod 134 can have an overall length of, for example, 36.5 inches. Again, this dimension is exemplary. Further, it is to be understood that rod 134, although referred to as being tubular, could be made from solid stock, or have any desired shape.

As noted above, right and left leg shaping assemblies 42, 44 can also be cuffing assemblies. Such assemblies can be used with either men's or women's trousers, but are particulary suitable for women's styles where no crease is desired. Reference should now be had to FIGS. 4A–4D, which depict a cuffing assembly of the present invention, designated generally as 146. It will be appreciated that FIG. 4B does not show the "front" and "back" of the assembly; the essential symmetry of the exemplary embodiment of the assembly can be seen in the top view, FIG. 4A. Each cuffing assembly 146 includes a central hub portion 148 secured to a respective one of the right and left leg support members 530, 532 at a location selected to permit engagement of the cuffing assemblies with cuff portions of the right and left trouser legs. One manner in which the central hub portion 148 can be fastened to the support members 530, 532 is via the four holes 152 which can be spaced to accept the four rods 134, and which can be secured in place, for example, with suitable set screws. Assemblies 146 could be located fairly close to the bottom of rods 134, in order to permit access to the cuffs of the trousers.

Cuffing assemblies 146 can also include at least three curved cuff-forming members 154 which are spaced substantially equi-angularly about the central hub portion 148. In a preferred embodiment, four cuff-forming members 154 are provided, as shown in the figures. Cuffing assemblies 146 can also include an elastically biased linkage 156 which is interposed between the at least three curved cuff-forming members 154 and the central hub 148. The elastically biased linkage, which, as noted, is designated generally as 156, can be configured to elastically bias the at least three curved cuff-forming members 154 outward from the central hub portion 148 to engage and form cuff portions of the respective right and left trouser legs when the trousers are introduced onto the apparatus 10. The figures show the linkage in a position wherein the cuff-forming members 154 are biased outwardly. Linkage 156 can also include a suitable actuator, to be discussed below, which retracts the at least three cuff-forming members 154 to permit easy introduction of the cuffing assemblies 146 into the respective right and left trouser legs. It will be appreciated that the apparatus 10 can be constructed such that the cuffing assemblies 146 can be freely interchangeable with the creasing assemblies 94.

Figure 4A:
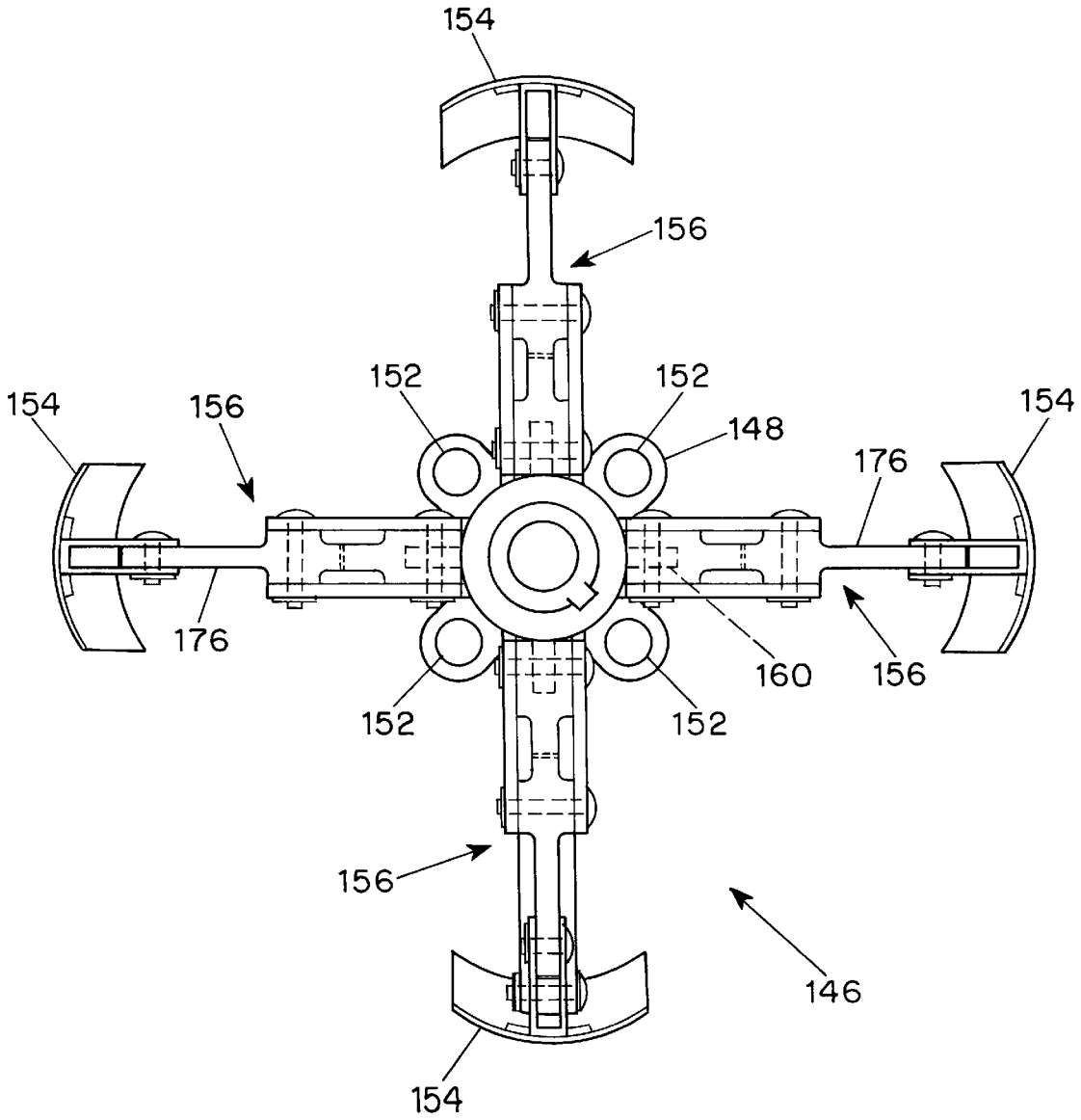
FIG. 4A is a top plan view of a cuffing assembly of the present invention.
Figure 4B:
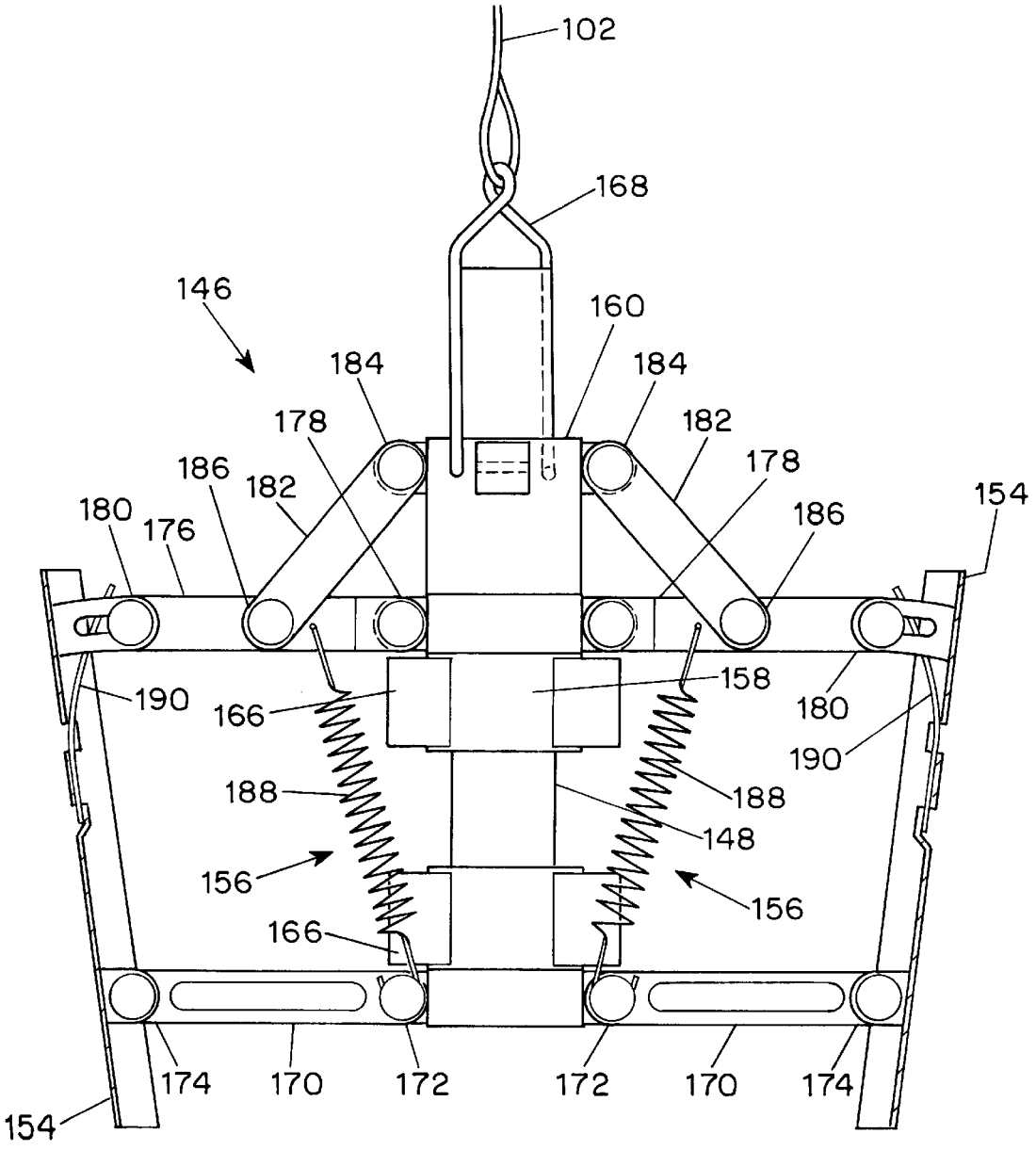
FIG. 4D is a side elevational view of the assembly of FIG. 4A.
FIG. 4C is a top plan view of a portion of a yoke of the assembly of FIG. 4B.
FIG. 4E is a view of a cuff-forming member of the present invention before it has been curved.
FIG. 4F is an end view of the cuff-forming member of FIG. 4E.
Figure 4C:
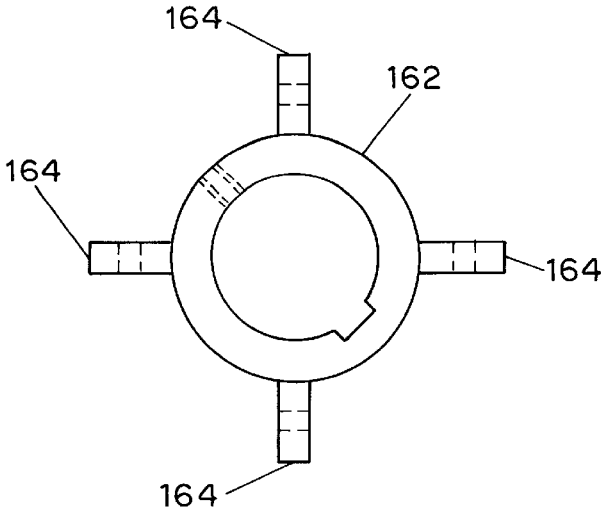
Figure 4D:
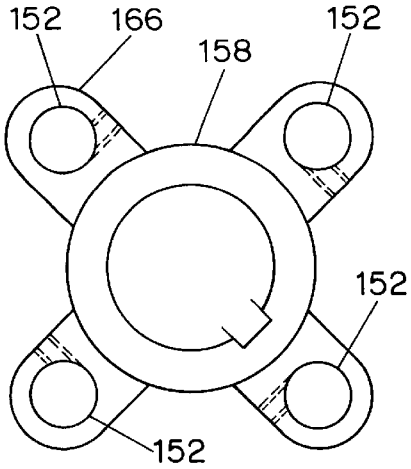

With continued reference to FIGS. 4A–4B, central hub portion 148 can include a fixed portion 158 which is secured to the respective one of the right and left leg support members 530, 532 and a yoke 160 which is slidable with respect to the fixed portion 158. Yoke 160 can include a collar member 162 with pivot points 164. Collar member 162 is best seen in FIG. 4C. Fixed part 158 of central hub portion 148 can include one or more sleeve members 166 with the aforementioned holes 152 for receiving the tubular rods 134.

The above-mentioned actuator can include a pulley, to be discussed below, and a cable (for example, the same cable 102 used to operate the creasing assemblies 94) secured at a first end to the pulley and at second end to the yoke 160 of the central hub portion 148. A suitable cable attachment member 168 can be fastened to the yoke 160 to receive the cable.

Elastically biased linkage 156 can include at least three lower link members 170 pivotally secured at first ends 172 to fixed portion 158 of hub portion 148. Link members 170 can have second ends secured to the at least three cuff-forming members 154 respectively. It is to be appreciated that one lower link member 170 can be provided for each cuff-forming member 154. The second ends of the lower link members 170 are designated as 174. Elastically biased linkage 156 can also include at least three main upper link members 176 having first ends 178 which are pivotally secured to the fixed portion 158 of the hub portion 148 and which have second ends 180 which are pivotally secured to the at least three cuff-forming members 154. Elastically biased linkage 156 can yet further include at least three secondary upper link members 182 having first ends 184 which are pivotally secured to the yoke 160 and having second ends 186 which are pivotally secured to intermediate portions of the at least three main upper link members 176. Thus, an upward force applied to the yoke 160 will cause the at least three main upper link members 176 and the at least three lower link members 170 to pivot upwardly and inwardly, thereby retracting the at least three cuff-forming members 154.

Cuffing assembly 146 can further include at least three elastic biasing members 188 which are mechanically interconnected between the at least three cuff-forming members 154 and the central hub portion 148 to bias the cuff-forming members 154 outwardly. Suitable members would be extension springs 188. It will be appreciated that two springs are visible in the view of FIG. 4B, but one could be provided for each of the cuff-forming members 154 shown in the top view, that is, FIG. 4A. It will appreciated that extension springs 188 bias cuff-forming members 154 outwardly by pulling down on upper link members 176. When yoke 160 is pulled upward to cause cuff-forming members 154 to pivot upwardly and inwardly, this action is done against the elastic force of the springs 188. Cuff-forming members 154 can have their upper ends biased elastically outwardly by suitable leaf springs 190, or other suitable means, in order to accommodate taper of the trouser legs which are being cuffed.

Figure 4E:
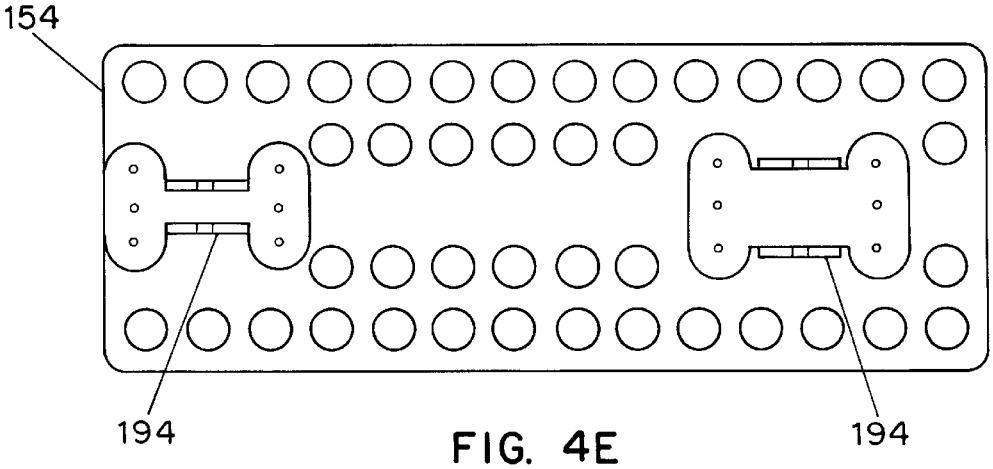
Figure 4F:
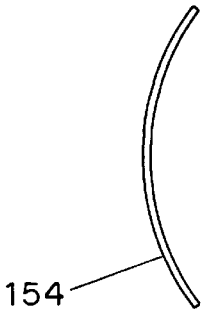

With reference now to FIGS. 4E and 4F, it will be appreciated that cuff-forming members 154 may be perforated, if desired, to permit steam to readily diffuse therethrough. Cuff-forming members 154 can include suitable pivot points 192, 194. In FIG. 4E, a cuff-forming member is shown in an un-curved state, before it is formed into a curved shape. In this planar state, it can have dimensions of approximately two inches by approximately 5⅜ inches. It can then be curved into a segment having a radius of approximately 1⁷⁄₁₆ of an inch and subtending an arc of approximately 39°. It is to be understood that the exemplary dimensions have been found suitable for cuffing a wide variety of trouser sizes. However, they are only exemplary in nature, and are not to be taken as limiting; any operable dimensions are within the scope of the invention.

Figure 5A:
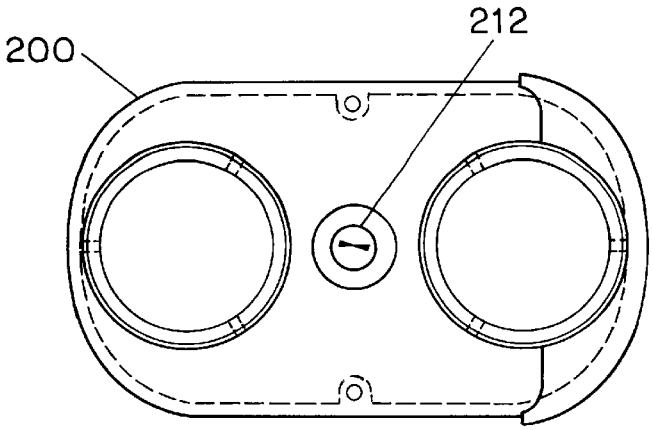
FIG. 5A is a top plan view of a base portion of a waist clamp assembly of the present invention.
Figure 5B:
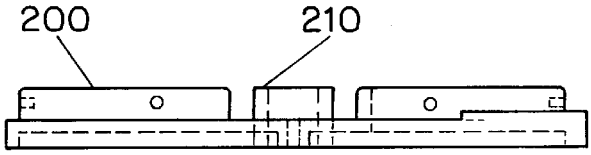
FIG. 5B is a front elevational view of the base portion of FIG. 5A.
Figure 5C:
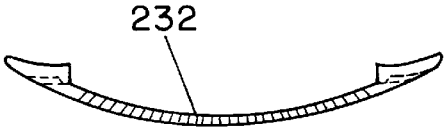
FIG. 5C is a top view of an arcuate lock plate of the waist clamp assembly of the present invention.
Figure 5D:
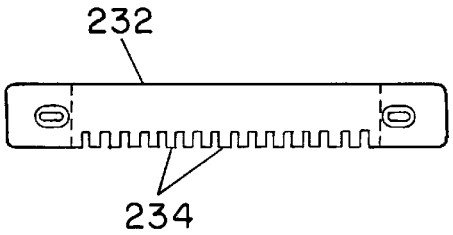
FIG. 5D is a front elevational view of the lock plate of FIG. 5C.
Figure 5E:
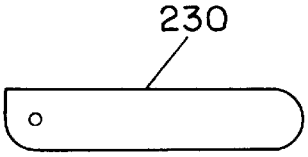
FIG. 5E is a transverse locking member of the waist clamp assembly.
Figure 5F:
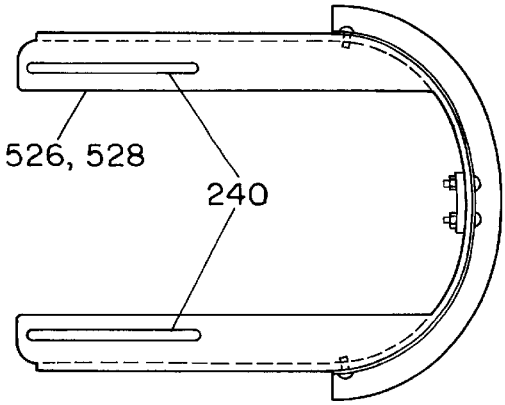
FIG. 5F is a top plan view of one of a first pair of waist clamp members.
Figure 5J:
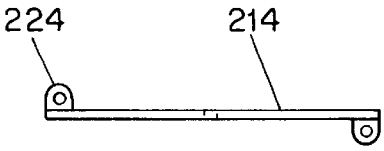
FIG. 5J is a top plan view of a bell crank member of the waist clamp assembly.
Figure 5G:
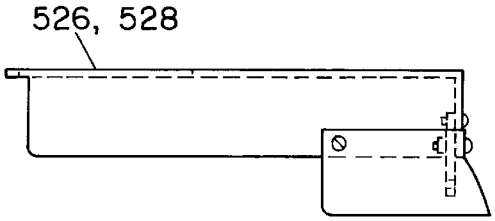
FIG. 5G is a side view of one of a first pair of waist clamp members.
Figure 5K:
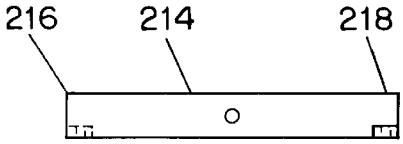
FIG. 5K is a side elevational view of the bell crank member of FIG. 5J.
Figure 5H:
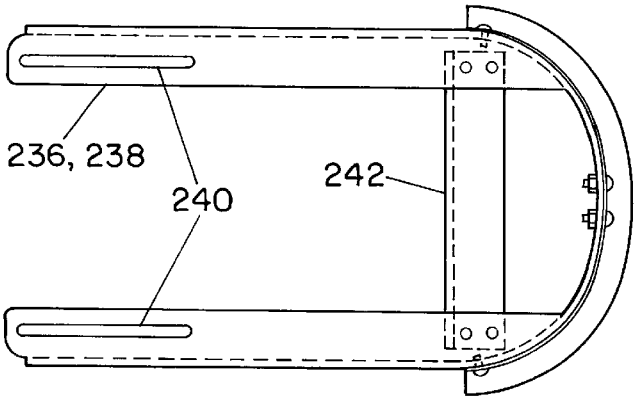
FIG. 5H is a top plan of view of one of a second pair of waist clamp members.
Figure 5L:
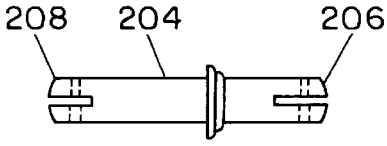
FIG. 5L is a front elevational view of a vertical pivot member of the waist clamp assembly.
Figure 5I:
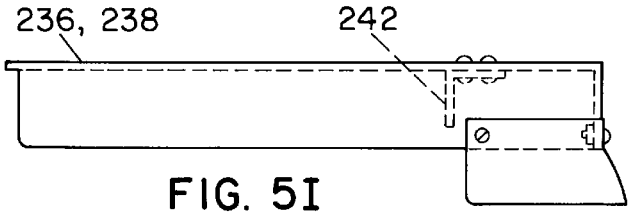
FIG. 5I is a side view of the member of FIG. 5H.

Reference should now be had to FIGS. 5A–5L, together with continued reference to FIGS. 1 and 2, for a more detailed description of one exemplary embodiment of waist clamp assembly 524. Waist clamp assembly 524 can include a base portion 200 affixed to the right and left leg steam ducts 22, 24. Further, the first and second waist clamp members 526, 528 can be a first pair of opposed, generally horseshoe-shaped members as shown in FIG. 5F and FIG. 5G. They can be slidably secured to the base portion 200 so as to translate between the first position, which was selected for easy introduction of the waist portion of the trousers over the waist clamp assembly, and the second, expanded position which was selected for secure retention and shaping of the waist portion of the trousers. The waist clamp assembly can also include a locking and actuating mechanism 202 which is interposed between the base portion 200 and the first pair of opposed waist form members 526, 528 to translate and lock the first pair of waist form members.

In one embodiment, the locking and actuating mechanism 202 can comprise a vertical pivot member 204 having upper and lower ends 206, 208 respectively. Pivot member 204 can be pivotally secured to the base portion 200, for example, by insertion in boss 210 having hole 212. Mechanism 202 can also include a bell crank member 214 which extends transversely from the lower end 208 of the pivot member 204 and which has opposed ends 216, 218. The locking and actuating mechanism can yet further comprise first and second push rods 220, 222 which are each pivotally secured at a first end to a respective one of the opposed ends 216, 218 of the bell crank member 214, and at a second end to a respective one of the waist form members 526, 528. The push rods 220, 222 can be secured, for example, to the tab portions 224 of the bell crank member 214 by insertion through holes therethrough. Further, suitable holes 226 can be provided on a plate portion 228 of each member 526, 528 of the first pair of waist clamp assembly members. Locking and actuating mechanism 202 can yet further include a transverse locking member 230 which is pivotally secured to the upper end of the vertical pivot member 204. Yet further, an arcuate lock plate 232 with a plurality of locking member receiving slots 234 can also be provided, and can be fixed to base portion 200. With continued reference to the figures, it will be appreciated that arcuate lock plate 232 can be raised up out of a given receiving slot 234 to permit vertical pivot member 204, and thus bell crank member 214, to pivot back and forth, thereby driving push rods 220, 222 inwardly or outwardly to expand or contract the first and second waist clamp assembly members 526, 528.

Yet further, a second pair of waist clamp members, such as a second pair of opposed, generally horseshoe-shaped waist form members 236, 238 can be provided and can be adapted to be interchangeable with the first pair of waist form members 526, 528. Each of the first and second pairs 526, 528 and 236, 238 can be sized to handle a different size range of trousers. For example, each of the pairs of members can have a width of approximately 6¾ inches but the second pair 236, 238 can be somewhat longer than the first pair 526, 528 to account for the larger waist sizes. It is to be understood that these dimensions are exemplary and are not to be taken as limiting. By making the different pairs approximately the same width, they can interchangeably ride on suitable projections from base portion 200 in slots 240. In order to use the same push rods 220, 222 with both sets of west clamp members, the second, or longer pair can have a supplemental angle iron piece 242 fitted to accept the push rods 220, 222. The first pair of waist clamp members can have an overall length of about 7³⁄₁₆ of an inch, while the second pair of members 236, 238 can have an overall length of about 10⁵⁄₁₆ of an inch. Again, these dimensions have been found useful in pressing a wide variety of trousers, but are exemplary in nature and should not be taken as limiting.

Figure 6A:
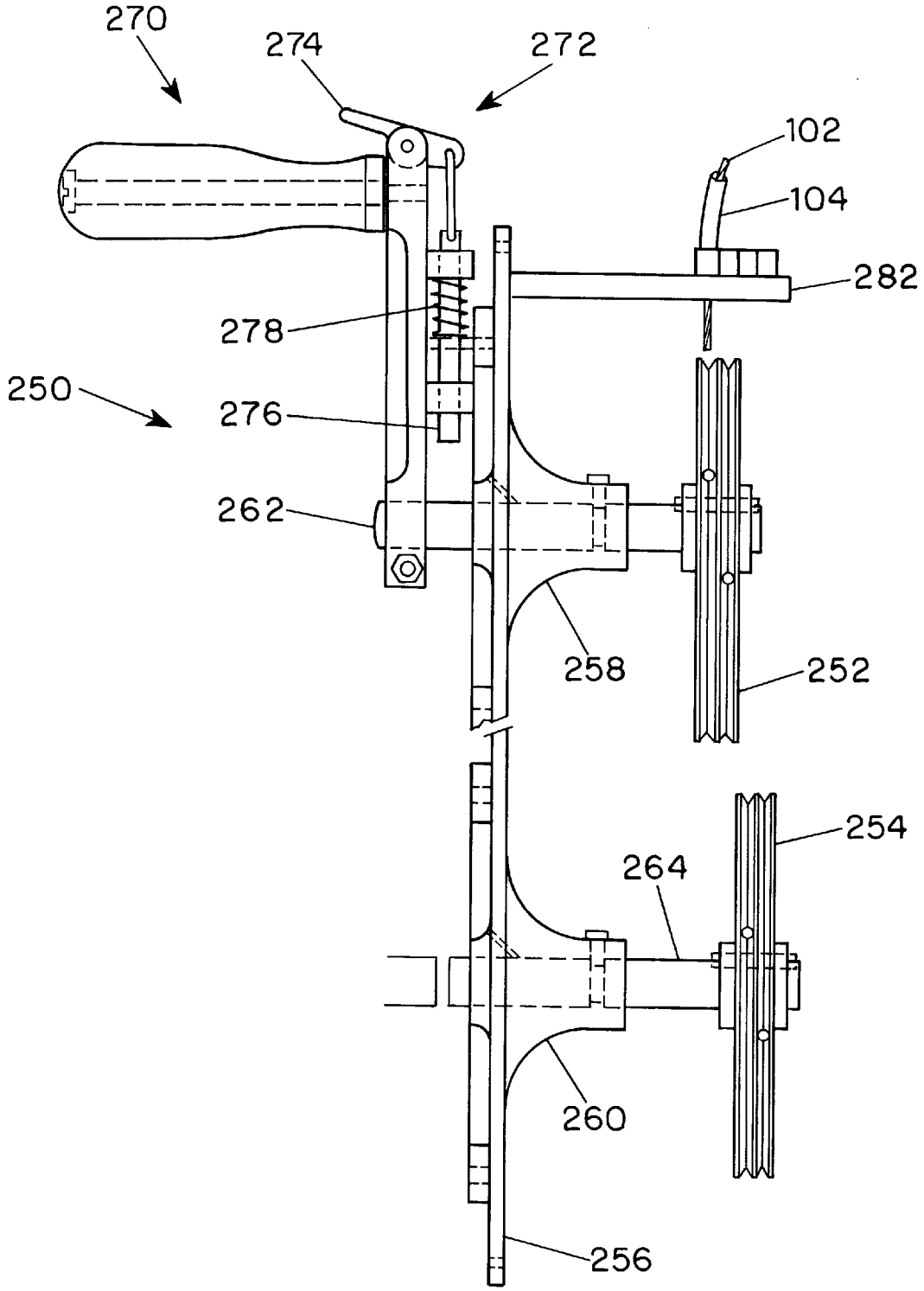
FIG. 6A is a transverse elevational view of a control panel of the present invention.
Figure 6B:
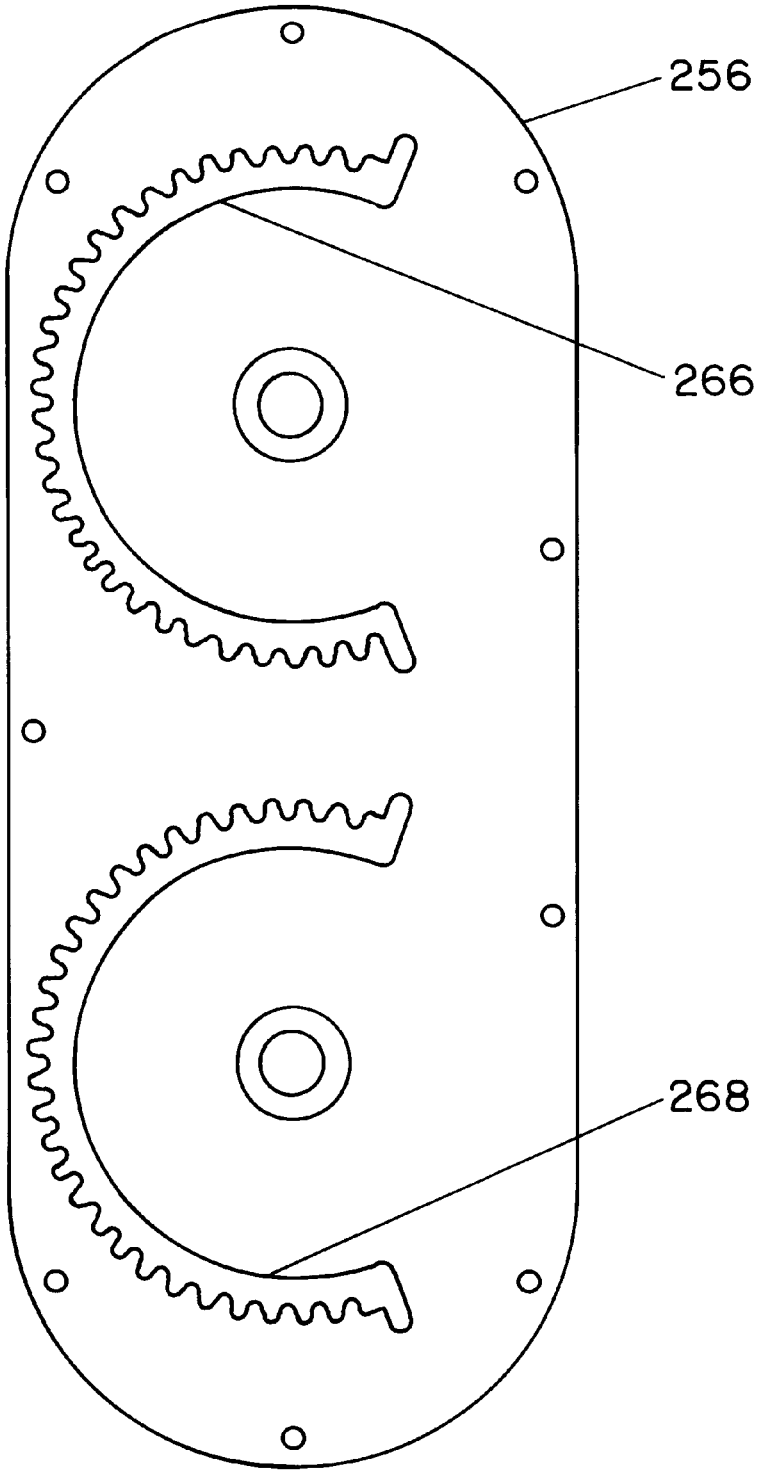
FIG. 6B is a side view of a base plate of the control panel assembly of FIG. 6A.

Attention should now be given to FIGS. 6A and 6B, together with FIGS. 1 and 2. A control panel, designated generally as 250, will now be discussed. Control panel 250 can mount pulleys 252, 254 as discussed above for receiving cables 84, 102. Control panel 250 can include a base plate 256 with first and second bosses 258, 260 for receiving axles 262, 264 of the pulleys 252, 254. Pulley 252 can be used, for example, for the cables 102 employed to operate the creasing assemblies 94 or cuffing assemblies 146. Pulley 254 can be used, for example, to operate the cables 84 employed in adjusting the upper portions 46, 48 of the leg support members 530, 532 on the cross member 62. It will be appreciated that each pulley 252, 254 can receive a pair of cables, so that the apparatus can be operated simultaneously, in a symmetrical fashion. Base plate 256 can include first and second ratchet portions 266, 268 which can subtend an angle of, for example, 226 degrees. Again, this angle is exemplary and should not be taken as limiting. Each of the axles 262 can be provided with a suitable handle 270 (a handle is shown only on the upper axle 262 for purposes of illustrative convenience.) Handle 270 can include a locking mechanism 272 with a finger pivot 274 and a locking member 276 for engaging the detents in the ratchets 266, 268. Thus, when it is desired to turn pulleys 252, 254, finger pivot 274 may be depressed to release lock member 276, handle 270 can be moved to an appropriate location, and then finger pivot 274 can again be released to cause lock member 276 to engage ratchet 266, 268 under the action of, for example, coil spring 278. The control panel 250 can be fitted to a control panel receiving flange area 280 located, for example, on the upright duct 18, and the cables 84, 102 in the sheaths 86, 104 can be routed through the ducts 22, 24, the manifold 12 and the upright portion 18. The sheaths 86, 104 of cables 84, 102 can be secured to a cross member 282 which is in turn fastened to base plate 256.

It should be understood that the elastic bias, cable and crank operation discussed above is exemplary in nature and that other forms of actuation, including hydraulic actuation, pneumatic actuation, electromechanical actuation, and the like can be employed. Further, although the biasing schemes shown are believed preferable, bias can be in the opposite direction. For example, upper portions 46, 48 of support members 530, 532 could instead be elastically biased apart and pulled together via cables, or other means. Further, creasing assemblies 94 could have blades 96, 98 biased away from each other and contracted via cables or other means. Yet further, cuffing assemblies 146 could have their cuff-forming members 154 biased inwardly by elastic or other means, and be expanded via cable or other actuation. Finally, lower portions 50, 52 of support members 530, 532 could be elastically biased inwardly instead of outwardly, and could then be expanded outwardly by other means once the trousers were in place.

Figure 7:
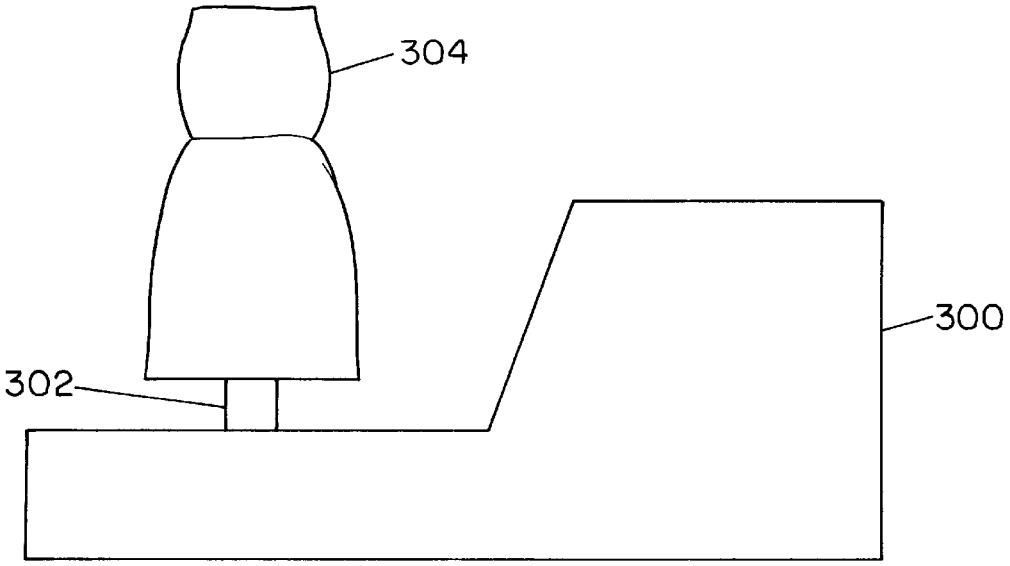
FIG. 7 (PRIOR ART)
FIG. 7 is a view of a dress form according to the prior art.

Brief reference should now be had to FIG. 7, which depicts a prior art steaming machine, such as the Cissell "SUZY" machine. The machine includes a base portion 300, an upright duct portion 302 and a dress form portion 304. With reference now to FIG. 8, it will be seen how the present apparatus can be adapted to work with an existing machine, such as the "SUZY" machine. The base 300 can receive the upright duct 18 which can be secured to the remainder of the apparatus, including the manifold 12 and the right and left leg ducts 22, 24. Waist clamp assembly 524 is also shown as is the left leg support member 532, which is depicted schematically. Also shown is the aforementioned form bag 88 which can be made of silk or similar material. Bag 88 includes right and left leg portions 90, 92 emanating from a central trunk or seat region. Again, it should be remembered that the left leg portion appears on the right and the right leg portion appears on the left, as explained above, since the trousers would normally be facing mounted outwardly on the apparatus.

FIG. 9 is a partial view of the apparatus, depicted semi-schematically, and viewed in the same direction as FIG. 2. The right and left leg ducts 22, 24 are shown, as is the waist clamp assembly 524, the transverse locking member 230 and the push rods 220, 222. Form bag 88 with right and left leg portions 90, 92 is again shown.

It will be appreciated that the form bag 88 bears against the interior portion of the trousers when steam is applied, and thus removes undesirable creases. Of course, desired creases can be formed with the aforementioned crease-forming members. When the steam is applied, the trousers will assume their natural shape corresponding to the spread position of the leg support members 530, 532. The second ends 38, 40 respectively of the right and left leg support members 530, 532 are best seen in FIG. 9.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. An apparatus for pressing a pair of trousers having right and left legs and a waist portion, said apparatus comprising:

a main steam supply manifold having an inlet end and an outlet end;

right and left leg steam ducts each having an inlet end in communication with said outlet end of said main steam supply manifold and each having an outlet end adapted to introduce steam into the right and left leg of the pair of trousers, respectively;

an expandable waist clamp assembly secured to said right and left leg ducts, said waist clamp assembly being expandable between a first position selected for easy introduction of the waist portion of the trousers over said waist clamp assembly and a second, expanded position selected for secure retention and shaping of the waist portion of the trousers;

elongate right and left leg support members each having first and second ends and a length sufficient to accept the legs of the trousers, said first ends of said leg form assemblies being pivotally mounted to said right and left leg ducts so as to pivot between a first horizontal position adapted for easy introduction of the trousers into the apparatus and a second vertical position adapted for pressing of the trousers; and right and left trouser leg shaping assemblies secured to said right and left leg support members respectively, said trouser leg shaping assemblies being adapted for insertion into the respective legs of the trousers and being expandable between a first position adapted for easy insertion of said leg shaping assemblies into the trouser legs and a second position where said shaping assemblies engage and shape said trousers, said right and left trouser leg shaping assemblies being located and dimensioned to press and shape at least lower portions of the right and left legs of the trousers.

2. The apparatus of claim 1, wherein said right and left leg support members are translatable towards and away from each other to accommodate different sized trousers.

3. The apparatus of claim 1, wherein said right and left leg support members comprise:

upper portions which are pivotally mounted to said ducts; and lower portions which are hinged and elastically biased with respect to said upper portions so as to swing towards each other for easy introduction of the trousers onto the apparatus and to be elastically biased away from each other for proper forming of the trousers.

4. The apparatus of claim 3, further comprising:

a cross member having first and second ends; and first and second rotary bearings having ball detents, said first and second rotary bearings being mounted respectively between said first and second ends of said cross member and said right and left steam ducts;

wherein:

said upper portions of said support members are slidably secured to said cross member with rotational fixity thereabout; and said ball detents are positioned to releasably secure said cross member in a position corresponding to at least one of said first horizontal and second vertical positions of said support members;

whereby said upper portions are pivotally mounted to said right and left steam ducts.

5. The apparatus of claim 4, wherein said cross member is formed with at least one longitudinal slot, said apparatus further comprising:

at least one transverse pin associated with each of said upper portions, said pins riding in said at least one longitudinal slot;

an elastic member positioned to bias said upper portions towards each other;

a pair of lockable pulleys; and a pair of cables each having a first end secured to a respective one of said upper portions and a second end secured to a respective one of said lockable pulleys.

6. The apparatus of claim 1, further comprising a steam-permeable form bag mounted to said waist clamp assembly, said form bag having right and left leg portions positioned to contain said leg support members and said trouser leg shaping assemblies, said form bag, including said right and left leg portions thereof, being adapted to be inserted into the trousers, including the right and left legs of the trousers, respectively.

7. The apparatus of claim 1, wherein said right and left leg shaping assemblies are creasing assemblies, said creasing assemblies each comprising;

a front blade member;

a rear blade member, said front and rear blade members being adapted to crease corresponding front and rear portions of the right and left trouser legs and being sized to crease substantially the whole length of the trouser legs; and an elastically biased linkage interposed between said front and rear blade members and said right and left leg support members respectively, said elastically biased linkage being configured to elastically bias said front and rear blade members in one of the first direction to permit easy insertion of said blade members into the respective trouser legs and a second direction to crease the trouser legs, said elastically biased linkage including an actuator which urges said blade members in another said first and second directions.

8. The apparatus of claim 7, wherein:

said actuator is a locking actuator which comprises:

a cable;

a lockable pulley to which said cable is secured; and upper and lower stop members secured to said cable;

said right and left leg support members are each formed with upper and lower longitudinal slots therein; and said elastically biased linkage comprises:

an upper pair of expanding links each having first ends pivotally secured to said front and rear blade members respectively and each having second ends pivotally secured together and slidable in said upper longitudinal slot, said upper pair of expanding links being configured to receive an upwardly-applied expanding force from said upper stop member when said cable is tensioned; and a lower pair of expanding links each having first ends pivotally secured to said front and rear blade members respectively and each having second ends pivotally secured together and slidable in said lower longitudinal slot, said lower pair of expanding links being configured to receive an upwardly applied expanding force from said lower stop member when said cable is tensioned, said lower stop member being spaced from said lower pair of expanding links so as to delay expansion of said lower pair of expanding links with respect to said upper pair of expanding links, whereby upper portions of the right and left trouser legs can be expanded further than lower portions thereof, so as to accommodate taper of the right and left trouser legs.

9. The apparatus of claim 1, wherein said right and left leg shaping assemblies are cuffing assemblies, said cuffing assemblies each comprising:

a central hub portion secured to a respective one of said right and left leg support members at a location selected to permit engagement of said cuffing assemblies with cuff portions of the right and left trouser legs;

at least three curved cuff-forming members spaced substantially equi-angularly about said central hub portion; and an elastically biased linkage interposed between said at least three curved cuff-forming members and said central hub, said elastically biased linkage being configured to elastically bias said at least three curved cuff-forming members in one of a first direction which is outward from said central hub portion to engage and form cuff portions of the respective right and left trouser legs when the trousers are introduced onto the apparatus and a second direction corresponding to retraction of said at least three cuff-forming members to permit easy introduction of said cuffing assemblies into the respective right and left trouser legs, said elastically biased linkage including an actuator which urges said at least three cuff-forming members in another of said first and second directions.

10. The apparatus of claim 9, wherein:

said central hub portion comprises:

a fixed portion secured to said respective one of said left and right leg support members; and a yoke slidable with respect to said fixed portion;

said actuator comprises:

a pulley; and a cable secured at a first end to said pulley and at a second end to said yoke of said central hub portion; and said elastically biased linkage comprises:

a least three lower link members pivotally secured at first ends to said fixed portion of said hub portion and at second ends to said at least three curved cuff-forming members, respectively;

at least three main upper link members pivotally secured at first ends to said fixed portion of said hub portion and at second ends to said at least three curved cuff-forming members, respectively;

at least three secondary upper link members pivotally secured at first ends to said yoke and at second ends to intermediate portions of said at least three main upper link members such that an upward force applied to said yoke causes said at least three main upper link members and said at least three lower link members to pivot upwardly and inwardly, thereby retracting said at least three cuff-forming members; and at least three elastic biasing members which are mechanically interconnected between said at least three cuff-forming members and said central hub portion to bias said cuff-forming members outwardly.

11. The apparatus of claim 9, wherein said cuff-forming members are perforated.

12. The apparatus of claim 9, wherein said cuff-forming members are elastically biased outward at upper ends thereof to aid in shaping the cuff portions of the trouser legs.

13. The apparatus of claim 1, wherein said waist clamp assembly comprises:

a base portion affixed to said right and left leg steam ducts;

a first pair of opposed, generally horseshoe-shaped waist form members slidably secured to said base portion to translate between said first position selected for easy introduction of the waist portion of the trousers over said waist clamp assembly and said second, expanded position selected for secure retention and shaping of the waist portion of the trousers; and a locking and actuating mechanism interposed between said base portion and said first pair of opposed waist form members to translate and lock said first pair of waist form members.

14. The apparatus of claim 13, wherein said locking and actuating mechanism comprises:

a vertical pivot member with upper and lower ends, said vertical pivot member being pivotally secured to said base portion;

a bell crank member extending transversely from said lower end of said vertical pivot member and having opposed ends;

first and second push rods each pivotally secured at a first end to a respective one of said opposed ends of said bell crank member and at a second end to a respective one of said waist form members;

a transverse locking member pivotally secured to said upper end of said vertical pivot member; and an arcuate lock plate having a plurality of locking member receiving slots therein, said arcuate lock plate being fixed to said base portion.

15. The apparatus of claim 14, further comprising a second pair of opposed, generally horseshoe-shaped waist form members adapted to be interchangeable with said first pair of waist form members, said first and second pairs of waist form members each being sized to handle a different size range of trousers.

16. An apparatus for pressing a pair of trousers having right and left legs and a waist portion, said apparatus comprising:

a main steam supply manifold having an inlet end and an outlet end;

right and left leg steam ducts each having an inlet end in communication with said outlet end of said main steam supply manifold and each having an outlet end adapted to introduce steam into the right and left leg of the pair of trousers, respectively;

an expandable waist clamp assembly secured to said right and left leg ducts, said waist clamp assembly having first and second horseshoe shaped members linearly moveable between a first position selected for easy introduction of the waist portion of the trousers over said waist clamp assembly and a second, expanded position selected for secure retention and shaping of the waist portion of the trousers; and elongate right and left leg support members each having first and second ends and a length sufficient to accept the legs of the trousers, said first ends of said leg form assemblies being mounted to said right and left leg ducts.

17. The apparatus of claim 16, further comprising right and left trouser leg shaping assemblies secured to said right and left leg support members respectively, said trouser leg shaping assemblies being adapted for insertion into the respective legs of the trousers and being expandable between a first position adapted for easy insertion of said leg shaping assemblies into the trouser legs and a second position where said shaping assemblies engage and shape said trousers, said right and left trouser leg shaping assemblies being located and dimensioned to press and shape at least lower portions of the right and left legs of the trousers.

* * * * *